US006180864B1

(12) United States Patent
Furuhashi et al.

(10) Patent No.: US 6,180,864 B1
(45) Date of Patent: Jan. 30, 2001

(54) TONE GENERATION DEVICE AND METHOD, AND DISTRIBUTION MEDIUM

(75) Inventors: Makoto Furuhashi; Takeshi Hashimoto, both of Tokyo (JP)

(73) Assignee: Sony Computer Entertainment Inc., Tokyo (JP)

( * ) Notice: Under 35 U.S.C. 154(b), the term of this patent shall be extended for 0 days.

(21) Appl. No.: 09/311,249

(22) Filed: May 13, 1999

(30) Foreign Application Priority Data

May 14, 1998 (JP) ..... 10-131929

(51) Int. Cl.[7] ..... G10H 7/00
(52) U.S. Cl. ..... 84/603; 84/604
(58) Field of Search ..... 84/602–604, 609, 84/606

(56) References Cited

U.S. PATENT DOCUMENTS 5,614,685 * 3/1997 Matsumoto et al. ..... 84/602
5,625,158 * 4/1997 Ichiki ..... 84/603
5,689,080 11/1997 Gulick .
5,847,304 * 12/1998 Hewitt ..... 84/604 X

FOREIGN PATENT DOCUMENTS

WO 97/31363 8/1997 (WO) .

* cited by examiner

*Primary Examiner*—Jeffrey Donels
(74) *Attorney, Agent, or Firm*—Helfgott & Karas, P.C.

(57) ABSTRACT

A device to perform tone generation while efficiently using a broad bit width bus and essentially eliminating the delay from the request for tone expression until its expression. An arithmetic processing device that generates tones reads the data all at once from a memory in which tone data is stored. This is set so that the delay time from when there is a request for tone generation until the tone is actually generated and expressed is negligible.

8 Claims, 5 Drawing Sheets

TONE GENERATION DEVICE AND METHOD, AND DISTRIBUTION MEDIUM

BACKGROUND OF THE INVENTION

Field of the Invention

This invention relates to a tone generation device, method and distribution medium. More specifically, the invention relates to a tone generation device, method, and distribution medium, whereby the quantity of data handled in the various processing stages, such as reading data for generating tones from memory, processing it, and storing it into memory again, is such that the delay time from when there is a request for expression of prescribed tone until it is actually expressed causes no problems, and it is handled collectively in a quantity such that the bus can be used effectively.

Advances in semiconductor technology have made it possible to have on a single chip an arithmetic processing device (for example, a central processing unit (CPU) or digital signal processor (DSP) and a main memory device (for example, dynamic random access memory (DRAM) or static RAM (SRAM)). Data is passed between them via a bus.

In a conventional tone generation device, sound source processing such as pitch conversion or envelope processing is done by these arithmetic processing devices with a period Ts (time of sampling period) corresponding to a sampling frequency of 44.1 kHz or 48.0 kHz, that is every 1/44,100 second or 1/48,000 second.

For example, as shown in FIG. 1, data for generating tones that is stored in a memory, etc. is read by the arithmetic processing device in a quantity corresponding to 1 Ts. Then the arithmetic processing device performs pitch conversion or other sound source processing on this 1-Ts data that has been read and temporarily writes it into memory for subsequent processing (processing by a later-stage arithmetic processing device). A tone is generated by repeating this operation as many times as necessary.

SUMMARY OF THE INVENTION

A large quantity of data (a quantity of data corresponding to a broad bit width) can be passed at one time, and the operation is done most efficiently, if the arithmetic processing device and the main memory device are connected by a bus whose clock frequency is high (high-speed) and whose bit width is broad. A bit width means the number of bits which can be transferred at once and is also referred as the width of data bus.

But with a conventional tone generation device as described above, the data needed for tone generation is passed between the arithmetic processing device and the main memory device (memory) in the small unit of 1 Ts, which corresponds to the sampling frequency.

Thus there has been the problem that if the tone generation device is comprised using an arithmetic processing device, a main memory device having a high-speed, broad bit width bus therebetween, because the data exchanged is small, it is difficult to transfer data efficiently.

The present invention reads from memory a quantity of data corresponding to n Ts all at once, performs sound source processing, and again stores it into memory as necessary, making it possible to efficiently use a high-speed, broad-bit-width bus.

The arithmetic processing device of the tone generator has a reading means that reads, via a broad bit width bus, data for generating tones that is stored in the main memory device as well as a generation means that generates tones using the data read by the reading means, and the reading means and generation means handle collectively data of n times (where n is an integer greater than or equal to 2) the tone sampling period.

The tone generation method of this invention also includes a step in which the arithmetic processing device reads, via a broad bit width bus, data for generating tones that is stored in the main memory device as well as a step in which the tone is generated using the data read in the reading step, and the reading step and generation step handle collectively data of n times (where n is an integer greater than or equal to 2) the tone sampling period.

Further, the distribution medium of this invention provides a program that is readable by a computer that causes the tone generation device to execute processing that is characterized in that it includes a reading step in which the arithmetic processing device reads, via a broad-bit width bus, data for generating tones that is stored in the main memory device as well as a generation step in which the tone is generated using the data read in the reading step, and the reading step and generation step handle collectively data of n times (where n is an integer greater than or equal to 2) the tone sampling period.

In the aforesaid tone generation device, tone generation method, and distribution medium, data for generating a tone is read, the tone is generated using the data that is read, and in this reading and generation, data of n times the tone sampling frequency is handled collectively.

In the following, an embodiment of this invention is described with reference to the attached drawings.

DETAILED DESCRIPTION OF THE PREFERRED EMBODIMENTS

The arithmetic processing device of the tone generator (symbols 8-1 to 8-4 in FIG. 2) has a reading means (for example, step S3 in FIG. 6) that reads, via a bus (12), data for generating tones that is stored in the main memory device (5) as well as a generation means (for example, step S4 in FIG. 6) that generates tones using the data read by the reading means, and the reading means and generation means handle or process collectively data of n times (where n is an integer greater than or equal to 2) the tone sampling period.

Figure 2:
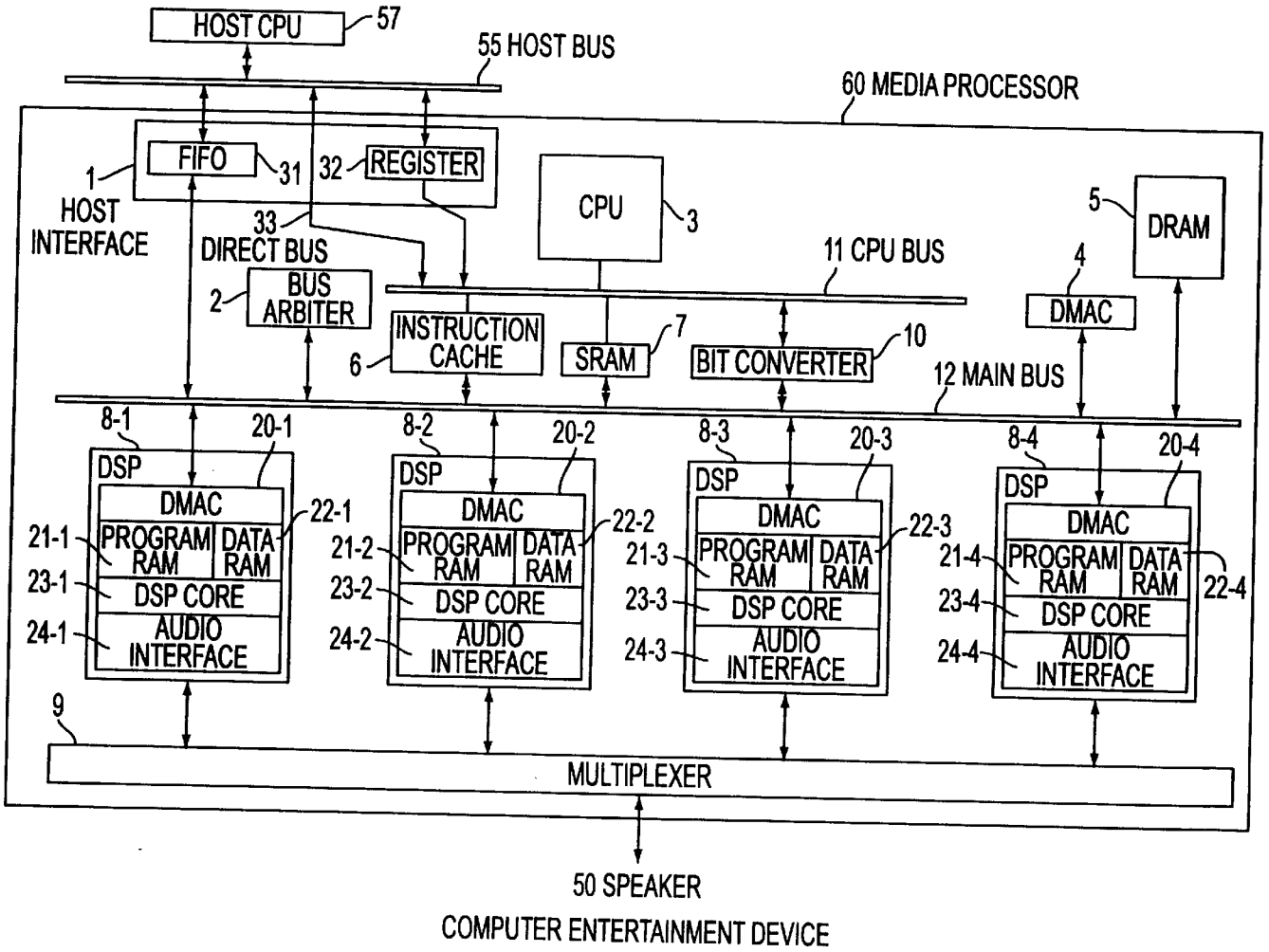
FIG. 2 is a block diagram showing the configuration of an embodiment of a computer entertainment device in which the tone generation device of this invention is widely used.

FIG. 2 is a block diagram of an example of the configuration in the case where the tone generation device is applied to a computer entertainment device. In this computer entertainment device, media processor 60, which consists of one LSI chip, is connected via host bus 55 to host CPU 57. Host interface 1 of media processor 60 consists of FIFO 31, register 32, and direct bus 33, each of which is connected to host bus 55.

Connected to CPU bus 11 of media processor 60 are register 32, direct bus 33, CPU 3, instruction cache 6, SRAM 7, and bit converter 10. Connected to main bus 12 of media processor 60 are FIFO 31, bus arbiter 2, instruction cache 6, SRAM 7, bit converter 10, DMAC (direct memory access controller) 4, DRAM 5, and digital signal processors (DSPs) 8-1 through 8-4.

Host CPU 57 executes various processing steps according to a program stored in a memory, not shown. For example, host CPU 57 may store programs and data from a recording medium such as a CD-ROM(compact disk, read-only memory), not shown, into DRAM 5 or conversely acquire programs and data stored in DRAM 5. In doing so, host CPU 57 makes a request to DMAC 4 and causes execution of a DMA transfer between FIFO 31 and DRAM 5. Also, host CPU 57 may directly access DRAM 5 and other devices via direct bus 33.

Bus arbiter 2 arbitrates the use rights to main bus 12. For example, when there is a request for data transfer from host CPU 57 to DMAC 4, bus arbiter 2 gives the bus access to DMAC 4 so that data transfer by DMA (direct memory access) can be made from host CPU 57 to DRAM 5.

FIFO 31 temporarily stores the data that is output from host CPU 57 and outputs it to DRAM 5 via main bus 12, and temporarily stores the data that is transferred from DRAM 5 and outputs it to host CPU 57. Register 32 is a register that is used when hand-shaking is done between host CPU 57 and CPU 3; it stores data that expresses the status of commands and processing.

CPU 3 accesses instruction cache 6, loads and executes the program stored therein, and as necessary accesses SRAM 7 and is supplied with the prescribed data. If there is no data that is needed for SRAM 7, CPU 3 makes a request to DMAC 4 and causes execution of a transfer of data by DMA from DRAM 5 to SRAM 7. If there is no program that is needed for instruction cache 6, CPU 3 makes a request to DMAC 4 and causes execution of a program transfer by DMA from DRAM 5 to instruction cache 6.

SRAM 7 can access any address and read and write data simultaneously from both CPU 3 and DMAC 4; for example, it is a dual-port SRAM and is provided as a data cache, and among the data stored in DRAM 5, it stores data that is frequently accessed from CPU 3. SRAM 7 may have a two-bank composition, one being connected to CPU bus 11 and the other to main bus 12.

Instruction cache 6 is a cache memory where any address can be accessed and data can be read and written; of the programs stored in DRAM 5, it stores programs that are frequently accessed from CPU 3.

Bit converter 10 converts the bit width of the data input via CPU bus 11 to the bit width (for example, 128 bits) corresponding to main bus 12 and outputs it, and converts the bit width (for example, 32 bits) of the data input via main bus 12 to the bit width corresponding to CPU bus 11 and outputs it.

DSP 8-1 consists of program RAM 21-1, which stores programs used when DSP core 23-1 performs various operations, data RAM 22-1, which stores data, DMAC 20-1, which manages the transfer of programs and data stored in these, and audio interface 24-1, which outputs to multiplexer 9 the audio data generated by DSP core 23-1.

Although the description is omitted, DSPs 8-2 through 8-4 likewise each have the same internal structure as DSP 8-1. Multiplexer 9 selects the audio data output from audio interfaces 24-1 through 24-4 and outputs it to speaker 50.

Figure 3:
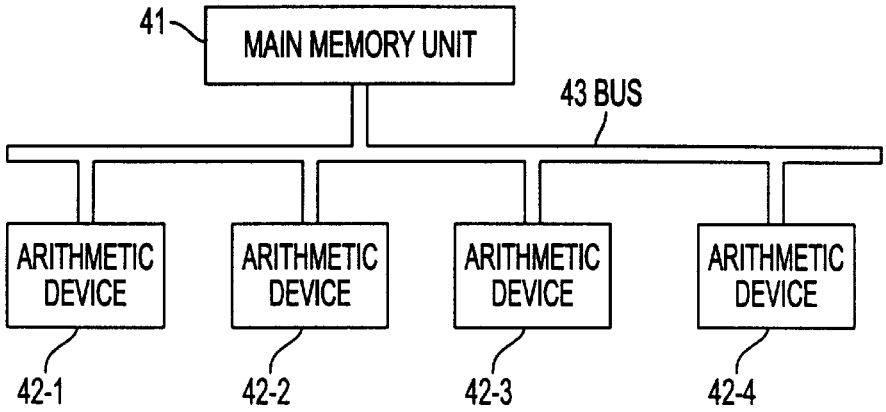
FIG. 3 is a block diagram showing the configuration of a tone generation device.

FIG. 3 is a block diagram of the composition of the tone generation device. Main memory unit 41 stores data for tone generation that is read from a CD-ROM or other recording medium not shown, as well as data in the generation process. This main memory unit 4 and arithmetic processing units 42-1 through 42-4 each are connected to bus 43, which has a sufficiently broad bit width (128 bits).

In making the correspondence between FIG. 3 and FIG. 2, main memory unit 41 corresponds to DRAM 5, arithmetic devices 42-1 through 42-4 correspond, respectively to DSPs 8-1 through 8-4, and bus 43 corresponds to bus 12.

As necessary, data stored in main memory unit 41 is read into arithmetic devices 42-1 through 42-4, expansion, pitch conversion, envelope processing, and effect processing, etc. are performed, and it is transmitted to and reproduced by a playback device, not shown.

Figure 4:
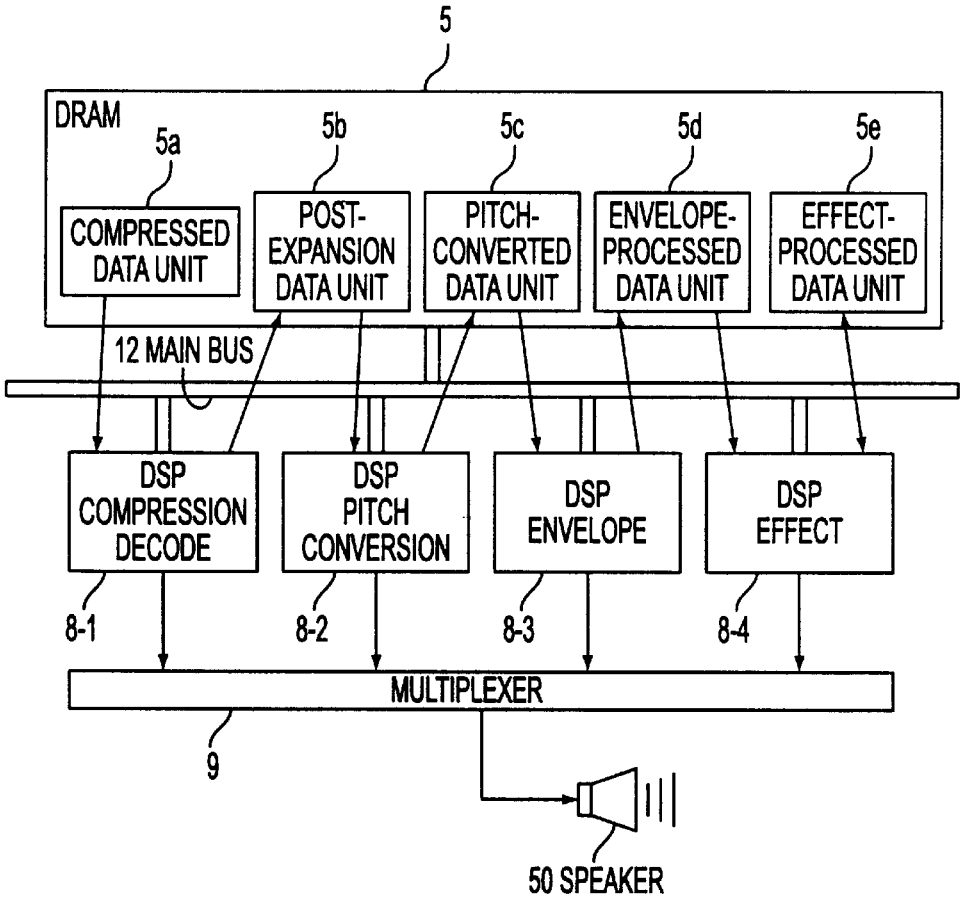
FIG. 4 is a diagram explaining the data flow in the tone generation device.

In FIG. 4, main memory unit 41 is DRAM 5, arithmetic devices 42-1 through 42-4 are, respectively, DSPs 8-1 through 8-4, bus 43 is the main bus, and the processing done by each unit and the flow of the data are indicated.

Compressed data of the tones that host CPU 57 reads from a CD-ROM or other recording medium, not shown, is stored in compressed data unit 5*a* of DRAM 5. The stored data is transferred to DSP 8-1 via bus 12. DSP 8-1 decodes (expands) the compressed data that is transferred. This expanded data is then either transferred to and stored in post-expansion data unit 5*b* of DRAM 5 or, as necessary, is reproduced by speaker 50 via multiplexer 9.

The data stored in post-expansion data unit 5*b* is read by DSP 8-2, and pitch conversion is performed on it. Pitch conversion means, when generating a tone, to generate another (higher) musical interval by, for example, taking the musical note "do" as the fundamental tone and changing the frequency of this fundamental tone. For example, if fast-forwarding is done in a cassette tape recorder (if more data than usual is played back per unit of time), the sound is heard at a higher pitch. It is clear from this fact that in order to make a sound higher, it is necessary to change the reading speed (pitch), read the next data, and increase the amount of data. Conversely, if a tone lower than the fundamental tone is to be expressed, it suffices to have data that is less than in the case when the tone is to be expressed at the fundamental tone.

The data that is pitch-converted by DSP 8-2 is either transferred to and stored in pitch-converted data unit 5*c* of DRAM 5 or, as necessary, is played back by speaker 50 via multiplexer 9.

Figure 5A:
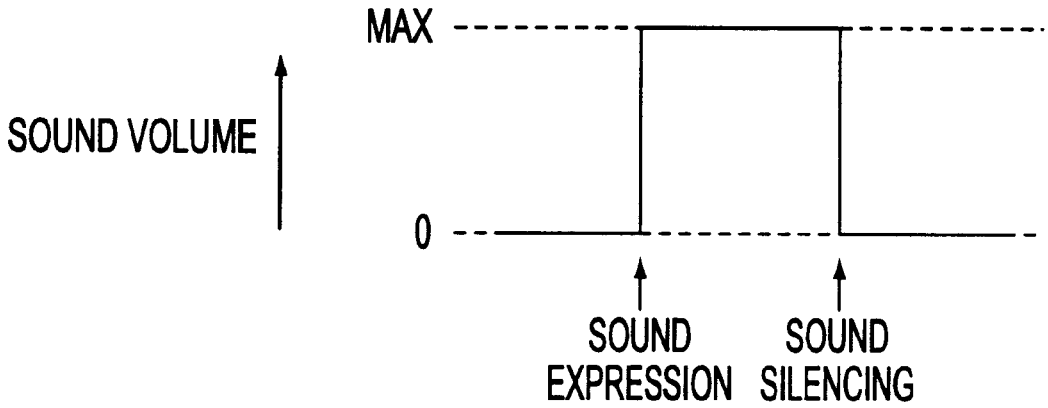
FIG. 5 is a diagram explaining envelope processing.
Figure 5B:
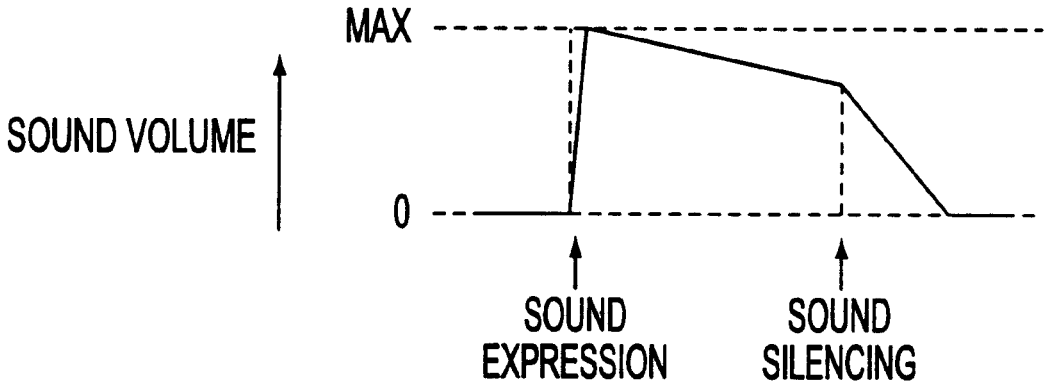

Data stored in pitch-converted data unit 5*c* is read by DSP 8-3, and envelope processing is performed. This envelope processing is done in order to change (set) the timbre. In order to change the timbre of a sound of the same musical interval, it suffices to vary the sound volume of the sound expression and sound silencing (attack and falloff). For example, the timbre of an organ can be reproduced if, as shown in FIG. 5(A), the sound volume reaches its maximum value immediately after the sound is initiated, a fixed sound volume continues, then the sound volume reaches its minimum value (disappears) immediately after the sound is silenced, and the timbre of a piano can be reproduced if, as shown in FIG. 5(B), the sound volume reaches its maximum volume gradually after the sound is initiated, it is gradually attenuated, then, after the sound is silenced, the sound volume grows gradually smaller.

In DSP 8-3, the envelope-processed data is either transferred to and stored in envelope-processed data unit 5*d* of DRAM 5 or, as necessary, is reproduced by speaker 50 via multiplexer 9.

The data stored in enveloped-processed data unit 5*d* is read by DSP 8-4, and effect processing is done on it. Effect processing is processing that adds a change to the sound, such as an echo or distortion. The effect-processed data is transferred to and stored in effect-processed data unit 5*e* of DRAM 5. When the effect processing is completed after being done only once, the processed data is expressed by speaker 50 via multiplexer 9.

If effect processing is done twice or more, first, the first-time effect processing is done by DSP 8-4, and this data is temporarily transferred to and stored in effect-processed data unit 5*e*. Then, if second-time effect processing is done, DSP 8-4 reads the data that is stored in effect-processed data unit 5*e* and performs the second-time effect processing on it. Thus effect processing is done multiple times by exchanging data between DSP 8-4 and effect-processed data unit 5*e*.

Figure 6:
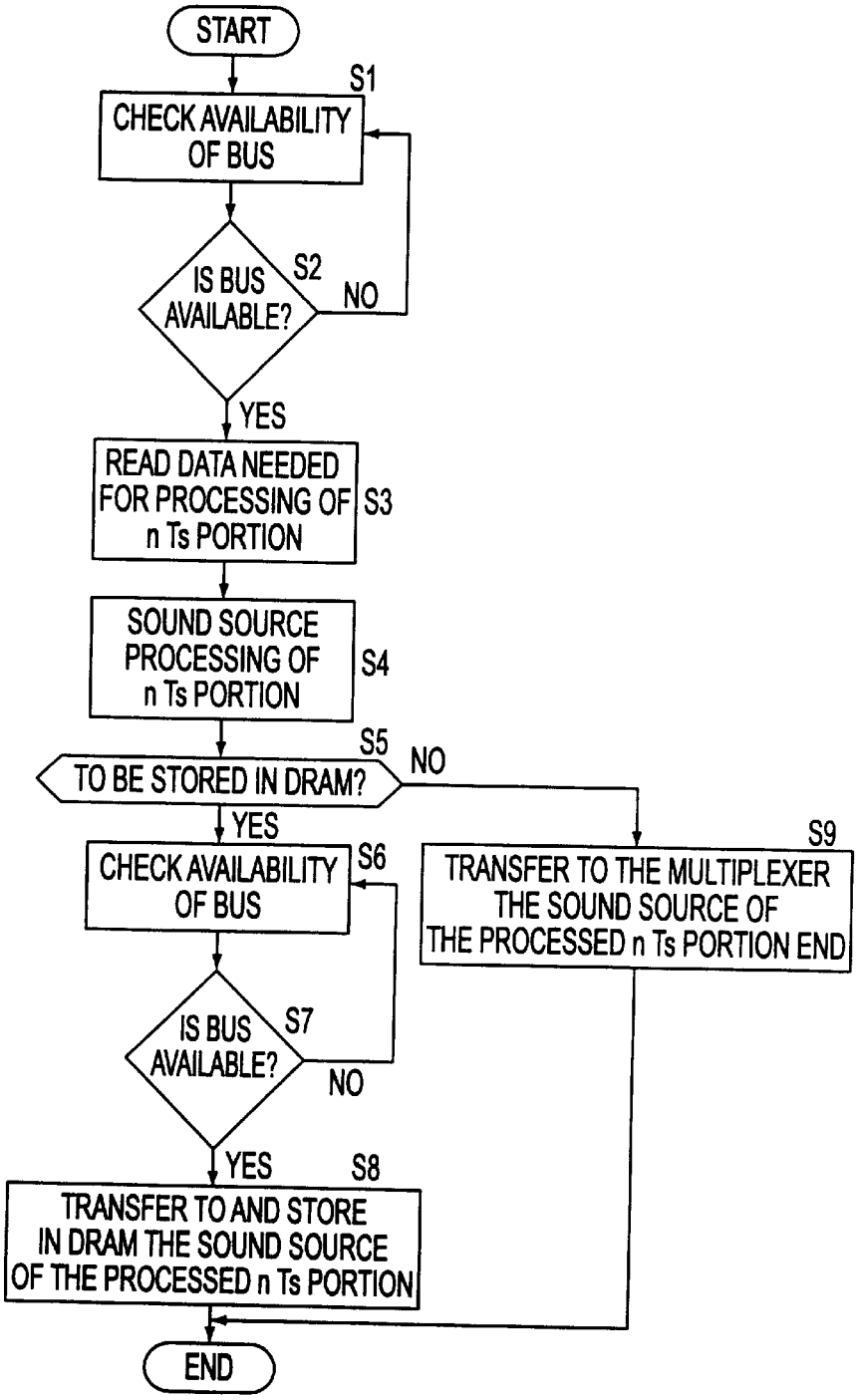
FIG. 6 is a diagram explaining the operation of the DSPs of FIG. 4.

The flowchart in FIG. 6 is referred to in describing the operations of the DSPs of the tone generation device shown in FIG. 4. An example is DSP 8-1 which performs expansion processing. In step S1, DSP core 23-1 of DSP 8-1 checks the availability of main bus 12. In step S2, using the result of the check of the availability of main bus 12 checked in step S1, DSP core 23-1 decides whether main bus 12 is in a usable state, in other words, whether another DSP 8-2 through 8-4, CPU 3, DMAC 4, etc. is transmitting or receiving data on it. This decision is made from the reply of bus arbiter 2. If it is decided that main bus 12 is not available, it returns to step S1, and the processing beginning there is repeated.

If in step S2 it is decided that main bus 12 is available, it proceeds to step S3. In step S3, DSP core 23-1 reads the data stored in compressed data unit 5*a* of DRAM 5. At this time, data corresponding to n Ts is read all at once. This Ts corresponds to the sampling frequency for waveform data for generating a tone, and assuming that the sampling frequency is 44.1 kHz, 1 Ts is $1/44{,}100$ second. That is, DMAC 20-1 DMA-transfers an amount of data corresponding to n Ts from DRAM 5 to data RAM 22-1 via main bus 12.

If the value of n in n Ts is greater than or equal to 2, the decision is made specifically in consideration of the following. First, if a large value of n is used, the quantity to be processed all at once increases, and the time from when a sound expression request is made until the above-described processing (pitch conversion, envelope processing, etc.) is done in DSP 8-1 through 8-4 and the sound is expressed by speaker 50, that is, the delay time from when a sound expression request is made until the sound is actually expressed, might reach a value that cannot be ignored, i.e., the delay might be long enough for the user to notice.

Conversely, if a small value of n is used, although there will be little danger of the above-described delay problem occurring, it will not be possible to make efficient use of main bus 12, which has a broad bit width (and therefore can transfer a large amount of data all at once). Taking these facts into consideration, n is set to a value such that the delay that arises from when a sound expression request is made until it is played back is not noticed by the user, and such that main bus 12 can be used efficiently.

The n Ts portion of compressed data read by DSP core 23-1 in step S3 is subjected to expansion processing in step S4. And in step S5, DSP core 23-1 decides whether to store the expanded data in DRAM 5, in other words, whether it is necessary to perform pitch conversion on it. If it is decided that there is no need to store the data in DRAM 5, it proceeds to step S9, and the n Ts portion of data on which expansion processing was done is transferred to multiplexer 9. Then, the transferred data is selected by multiplexer 9, is output to speaker 50, and is expressed.

If in step S5 it is decided that the data is to be stored in DRAM 5, it proceeds to step S6, and the availability of main bus 12 is checked. The processing of this step S6 and that step S7 is the same processing as the processing of step S1 and step S2, so an explanation of it is omitted.

If in step S7 DSP core 23-1 decides that main bus 12 is available, it proceeds to step S8, and DMAC 20-1 takes the expansion-processed data and DMA-transfers it to and stores it in post-expansion data unit 5*b* of DRAM 5 via main bus 12.

The processing of the flowchart in FIG. 6 is done in the same way for DSPs 8-2 through 8-4 as well. However, in DSP 8-2, the data read in step S3 is data that has been stored in post-expansion data unit 5*b*, the processing done in step S4 is pitch conversion processing, and in step S8 the destination to which the data is transferred is pitch-converted data unit 5*c*. In DSP 8-3, the data read in step S3 is data that has been stored in pitch-converted data unit 5*c*, the processing done in step S4 is envelope processing, and in step S8 the destination to which the data is transferred is envelope-processed data holding unit 5*d*.

In DSP 8-4, the data read in step S3 is data that has been stored in envelope-processed data unit 5*d* or effect-processed data unit 5*e* (if effect processing is done two or more times), the processing done in step S4 is effect processing, and in step S8 the destination to which the data is transferred is effect-processed data unit 5*e*.

Figure 1:
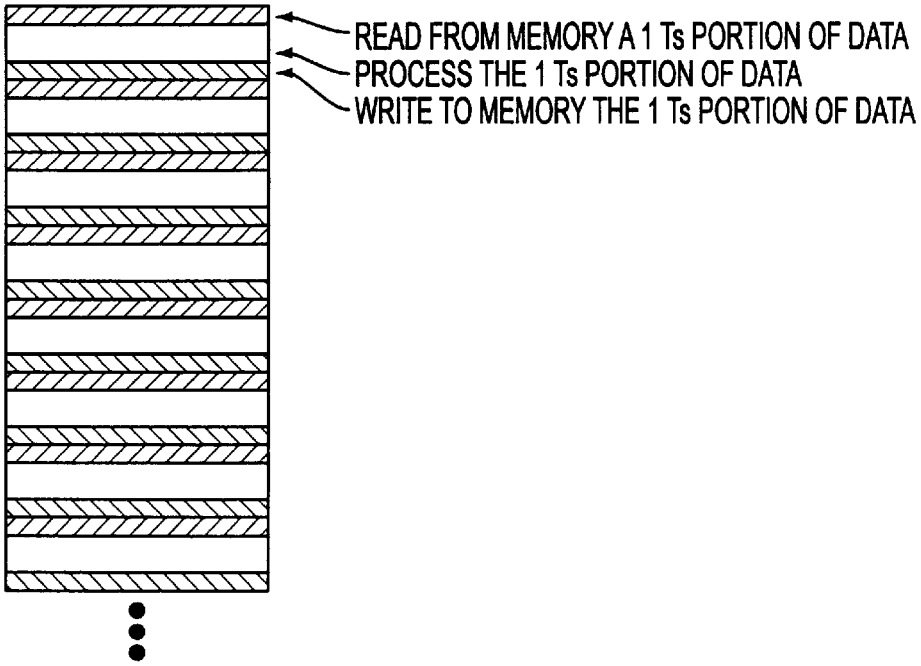
FIG. 1 is a diagram that explains conventional data reading, processing, and writing.
Figure 7:
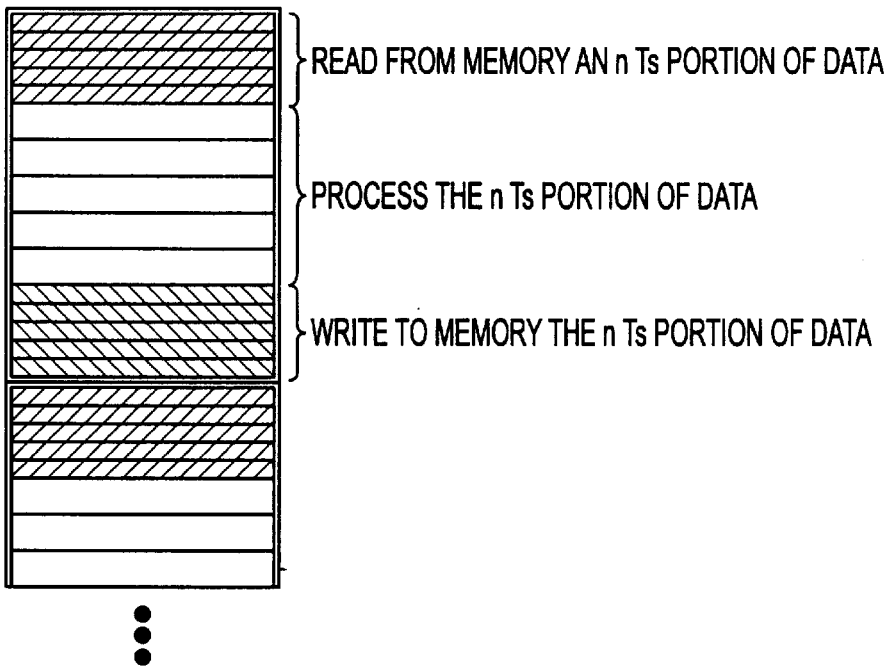
FIG. 7 is a diagram explaining data reading, processing, and writing.

As described above, with the tone generation device of this invention, as shown in FIG. 7, each DSP (arithmetic device) reads data corresponding to n Ts all at once, the read n Ts portion of data is processed all at once, and for subsequent processing, the processed n Ts portion of data is written into DRAM or other memory all at once, so a broad-bit width bus can be used efficiently, and tone generation can be done without the occurrence of any delay.

The distribution medium by which the user is provided with computer programs that execute the above processing includes, besides information recording media such as magnetic disk and CD-ROM, distribution media by networks, such as Internet or digital satellite.

As described above, with the tone generation device, tone generation method, and distribution medium, the arithmetic processing device reads, via a bus, data for generating tones stored in a main memory unit, and when it generates a tone using the read data, data of n times the tone sampling period is handled all at once, thus making it possible to efficiently utilize a broad bit width bus.

What is claimed is:

1. A tone generation device having an arithmetic processing device and a main memory device connected by a bus wherein said arithmetic processing device has reading means that reads, via said bus, data for generating tones from said main memory device;

tone generation means generating tones using the data read out by said reading means, and wherein said reading means and said tone generation means collectively read data on the tone of n times a sampling period (Ts) and then process said data all at once, where n is an integer greater than or equal to 2, and wherein said n is set to a value such that a user is not aware of the delay time from expression of a requested prescribed tone until said prescribed tone is generated and expressed by said tone generation means, and the bus can be used effectively.

2. The tone generation device of claim 1 wherein the bus is an 128-bit width bus.

3. In a computer entertainment system having at least a host CPU, a host bus, and a media processor that generates tones, said computer entertainment system wherein said media processor has an arithmetic processing device, a main memory device, and a bus over which data is transferred between them, and in said data transfer, data on the tone of n times a sampling period (Ts) is processed collectively, where n is an integer greater than or equal to 2, and wherein said n is set to a value such that a user is not aware of the delay time from expression of a requested prescribed tone until said prescribed tone is generated and expressed by said media processor, and the bus can be used effectively.

4. The computer entertainment system of claim 3 wherein the arithmetic processing device, the main memory device, and the bus are formed on a single semiconductor chip.

5. The computer entertainment system of claim 3 wherein the arithmetic processing device consists of one or two or more digital signal processors.

6. The computer entertainment system of claim 1 wherein each digital signal processor consists of any of an expansion processing means that expands tone compressed data, a pitch conversion processing means that changes the frequency when the tone is generated, an envelope processing means that changes the timbre of the tone and an effect means that changes to the tone.

7. A tone generation method for a tone generation device in which an arithmetic processing device and a main memory device are connected by a bus, comprising the steps of:

operating the arithmetic processing device to read data for generating a tone from said main memory device via said bus; and generating the tone using the data read in said operating step, and said operating step and said generating step collectively read data on the tone of n times, a sampling period (Ts) and then process said data all at once, where n is an integer greater than or equal to 2, and wherein said n is set to a value such that a user is not aware of the delay time from expression of a requested prescribed tone unit said prescribed tone is generated and expressed by said generating step, and the bus can be used effectively.

8. A distribution medium that provides a program that is processed by a tone generation device in which an arithmetic processing device and a main memory device are connected by a bus, and which program can be read by a computer, said program being programmed to perform the steps of:

operating the arithmetic processing device to read data for generating a tone from said main memory device via said bus and generating the tone using the data read in said operation step, and said operating step and generating step collectively reading out data of n times the tone sampling period and processing said data all at once, where n is an integer greater than or equal to 2, and wherein said n is set to a value such that a user is not aware of the delay time from expression of a requested prescribed tone until said prescribed tone is generated and expressed by said generating step, and the bus can be used effectively.

* * * * *